US005927807A

United States Patent [19]

Heller

[11] Patent Number: 5,927,807

[45] Date of Patent: Jul. 27, 1999

[54] WATER SUPPORT DEVICE FOR CHAIRS

[76] Inventor: Hilary A. Heller, 110 Plantation Dr., Carson City, Nev. 89703

[21] Appl. No.: 09/081,349

[22] Filed: May 19, 1998

[51] Int. Cl.[6] ..... A47C 3/025

[52] U.S. Cl. ..... 297/284.3; 297/452.41

[58] Field of Search ..... 5/654, 655.5; 297/284.6, 297/452.41, DIG. 3, 452.23, 452.21, 284.3, 452.29, 452.33, 452.3, 284.1

[56] References Cited

U.S. PATENT DOCUMENTS

| | | |
|---|---|---|
| 4,143,909 | 3/1979 | McFarlin . |
| 4,555,140 | 11/1985 | Nemoto . |
| 4,707,872 | 11/1987 | Hessel . |
| 4,932,721 | 6/1990 | Anthony . |
| 5,135,282 | 8/1992 | Pappers . |
| 5,419,612 | 5/1995 | Rassekhi . |
| 5,461,741 | 10/1995 | Graebe . |
| 5,592,706 | 1/1997 | Pearce . |
| 5,642,544 | 7/1997 | Munoz . |
| 5,689,845 | 11/1997 | Sobieralski . |

FOREIGN PATENT DOCUMENTS

| | | |
|---|---|---|
| 3334864 | 4/1985 | Germany . |

*Primary Examiner*—Milton Nelson, Jr.
*Attorney, Agent, or Firm*—Willie Krawitz

[57] ABSTRACT

A flexible, water bed pad support system for reclining chairs and the like. The water bed pad is attached to the chair and comprises a plurality of integrally connected, plastic cells containing water or a similar material such as a water mix solution. An orifice such as bleed valves and/or narrow pipe orifices are provided at the junction or connection areas between adjacent cells, and the bleed valves enable water movement between adjacent cells in response to variations in pressure changes when a person shifts on the chair. These pressure change responses result in the water bed pad to slowly conform to the body curvature of a person, and equalize the support under the chair.

1 Claim, 2 Drawing Sheets

WATER SUPPORT DEVICE FOR CHAIRS

BACKGROUND OF THE INVENTION

The present invention relates to a water support device that is adapted for use with chairs of all sizes and types wherein the water support device can be mounted over the back and seating area of a chair or more preferably under the upholstery of the chair so that it will conform to the configuration of the particular chair structure or design.

An object of the present invention is to provide a means by which the user thereof can be supported by a panel or individual panels comprising a multiplicity of compartments or cells which are formed from a base sheet of suitable plastic superposed thereover. A second sheet of plastic defines a water housing having compartments or cells contiguously arranged and having a valve means disposed at a junction defined by a group of four cells. This allows the water stored in cells to be equally distributed within each surrounding cell when pressure is applied to a multiplicity of cells. Thus, the water filled cells define an internal pressurizable element that reacts to the user's body configuration and weight.

Another object of the invention is to provide a chair that is adapted with the water support device and wherein a pressure equalization affect is created among the surrounding pressurized cells, whereby the body weight of the individual when seating or reclining in a chair will cause the surface of the chair to conform to his or her body weight, structure and configuration so as to establish a means by which the user thereof is more comfortable in a more suitable self adjusting contoured chair. The pressure equalization effect is established by interposed valve members that are interconnected to the surrounding group of cells. Preferably, each valve member is provided with at least a two or four-way check valve that allows the water or a water mixed solution to flow into any one or all of the surrounding cells.

The present invention is particularly useful and suitable when used in combination with a reclining chair, wherein the water support device can be mounted to various sections of the chair including the adjustable leg support member that is generally provided with reclining chairs.

A further object of the present invention is to provide a water support device that can be suitably used in conjunction with heating elements, whereby the water solution can be heated to provide warmth in combination with a vibrator that will provide a soft but direct massaging action throughout the water support device.

Still another object of the present invention is to provide a water support device that can be readily attached to the internal structure of the chair or any, other suitable resting devices that would be an aid to those suffering from various medical problems, sports fatigue, and for just plain comfort to the user while sitting in the chair.

It may thus be seen that the objects of the present invention set forth herein, as well as those made apparent from the foregoing description, are efficiently attained. While the preferred embodiment of the invention has been set forth for purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

DESCRIPTION OF THE PREFERRED EMBODIMENT

Figure 1:
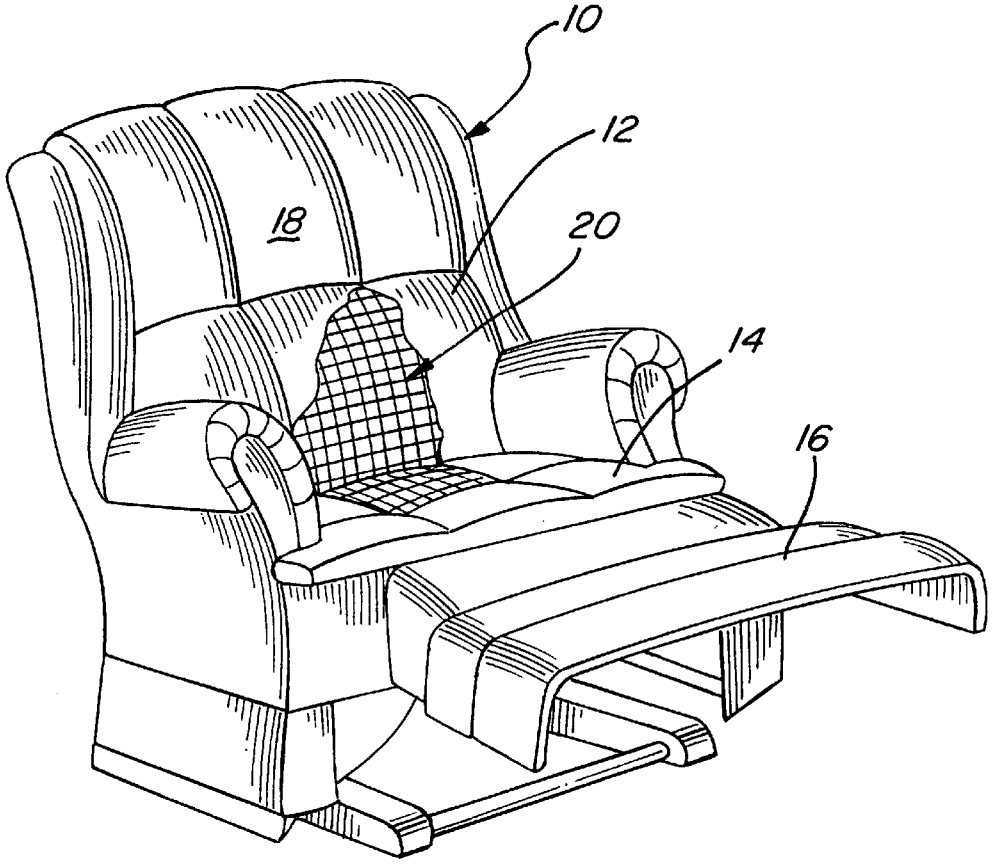
FIG. 1 is a pictorial view of a recliner chair that is illustrated having a section thereof removed so as to show the water support device of the present invention.

Referring now to FIG. 1, there is illustrated a typical reclining chair, generally designated at 10, which comprises an upright back support cushion 12, a seat cushion 14 and a leg rest or support member 16 that is adapted to be extended or retracted as is well known with such reclining chairs. The chair is suitably covered with an upholstery material 18 which is broken away to show the placement of a water support device 20 that is suitably arranged and positioned to be engaged by the user's body when seated in reclining chair 10. As seen in FIG. 1, the water support device 20 is also positioned under the outer cover of the seat cushion 14 and would be also mounted on the leg rest member 16.

Accordingly, the water support device is readily adapted to fit various other types of chairs or body-support furniture and is thus not restricted to reclining chairs. As an example, the present invention can be employed with wheel chairs.

Figure 2:
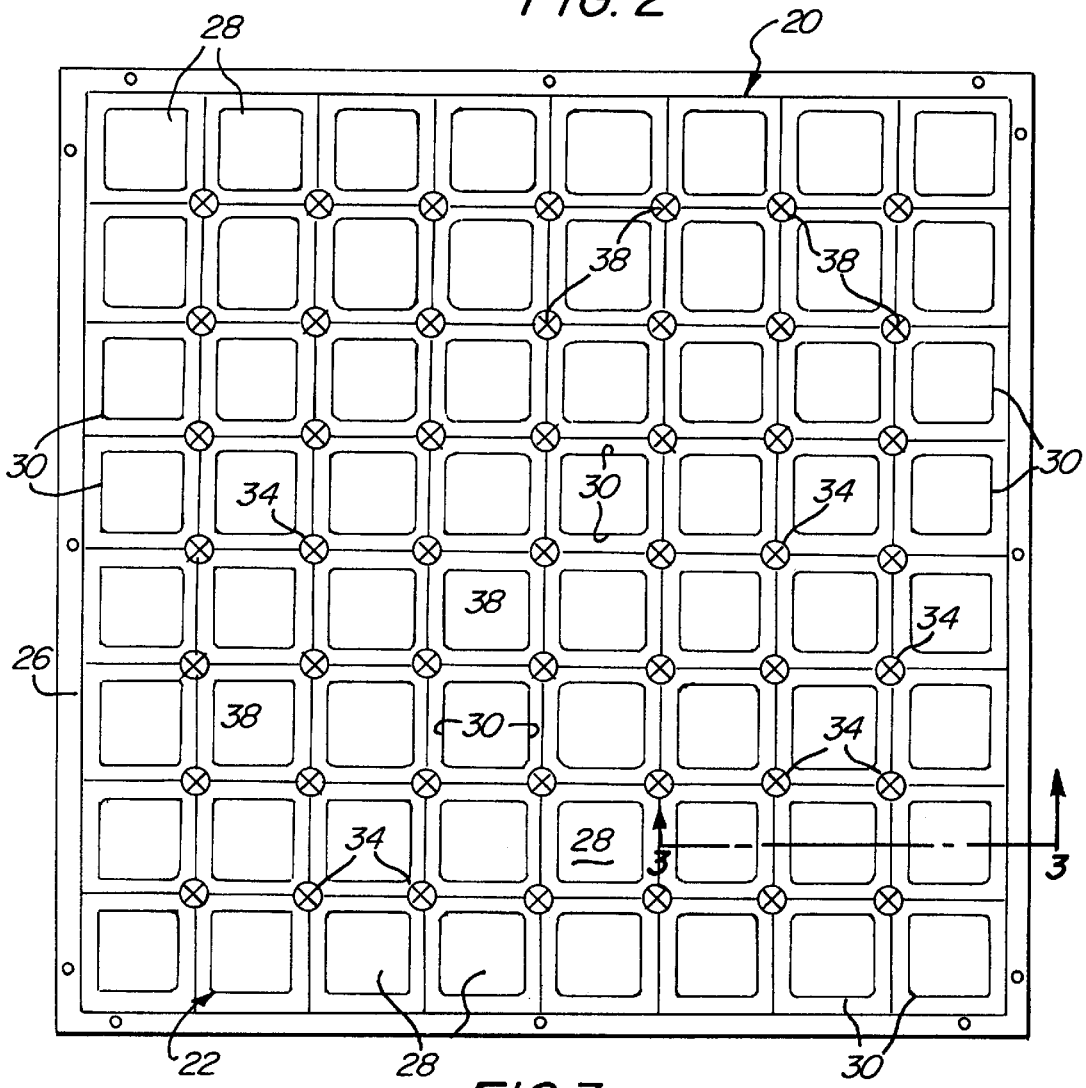
FIG. 2 is top plan view of a section of the water support device in which the water cells are shown juxtaposed with each other and wherein a valve member is disposed at the junction of a group of four cells.
Figure 3:
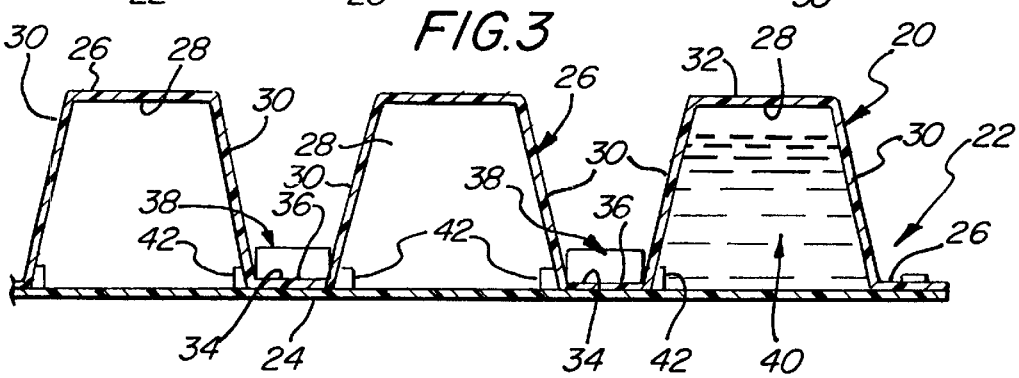
FIG. 3 is an enlarged cross-sectional view of the water support device taken substantially along line 3—3 of FIG. 2.

Referring more particularly to FIGS. 2 and 3, the water support device 20 comprises one or more water pads, generally designated at 22, which is formed from one or more sheets of impervious material, more especially a suitable plastic.

For simplicity the water pad is illustrated as having a base member or sheet 24 on which is suitably mounted a cover member or sheet 26 formed having a plurality of cells or compartments 28. The cells are shown as having a box-like configuration defined by four side walls 30 that are inclined inwardly and upwardly with an upper top wall 32. The side walls 30 terminate at their base and are integrally connected to surrounding juxtaposed cells by means of web members 34. This arrangement provides a means which allows flexibility for each cell 28 when pressure is applied to the body engaging cells as the user sits or rests against the upright back support cushion 12, the seat cushion 14, and the leg rest or support 16.

The juxtaposed arrangement of the cells and their configuration provide a suitable space or junction 36 on the surface of the cover sheet 26 of water pad 22, whereby a suitable valve means, indicated generally at 38, is affixed at each junction so as to communicate with the respective surrounding group of cells 28. Each valve is of the type that allows in and out flow of a water solution 40 through ports 42 as pressure is applied to the engaged cells.

Figure 4:
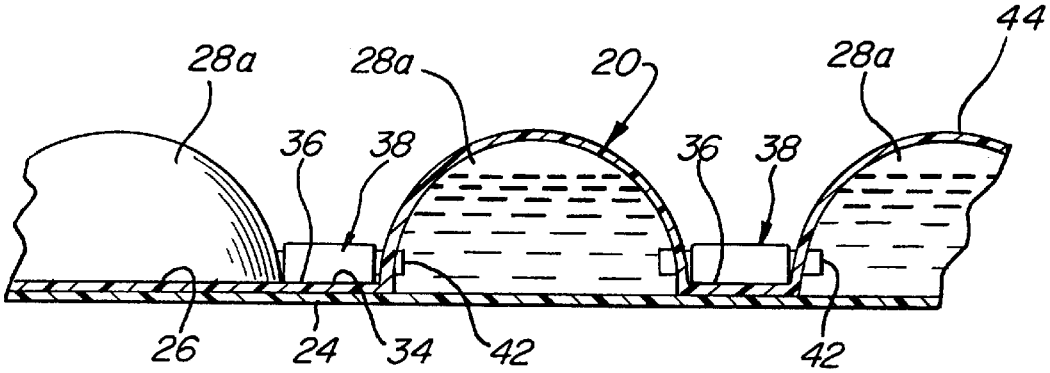
FIG. 4 is another enlarged cross-sectional view of the water support device that illustrates a second embodiment of the present invention.

There is shown in FIG. 4 an alternative embodiment of the present invention which comprises a multiplicity of cells 28*a* that are each formed having a dome shell 44 which reacts in the same manner as described above for cells 28.

The foregoing should only be considered as illustrative of the principles of the invention. Further, since numerous modifications and changes may readily occur to those skilled in the art, it is not desired to limit the invention to the exact construction and operation as shown and described, and accordingly, all suitable modifications and equivalents may be resorted to, falling within the scope of the disclosed invention.

I claim:

1. A flexible support for chairs and beds, comprising a plastic support member defining a plurality of integrally connected, plastic cells, each cell containing water, the plastic cells providing a plurality of connecting junctions including orifice pipes and internal, bleed and check valves disposed along the junctions and between a group of adjacent cells, thereby enabling non-pulsating movement of water between the cells through the orifice pipes in response to variations in pressure changes due to resting and body movement of a person on the chair support, thereby causing the plastic support member to slowly conform to corresponding contour areas of body curvature and weight of the person, and to equalize support under the chair for the person.

* * * * *